United States Patent [19]

Usui et al.

[11] Patent Number: 4,565,461

[45] Date of Patent: Jan. 21, 1986

[54] PITCH-CHANGEABLE, CAM-ACTUATED PAPER FEED FOR SERIAL PRINTER

[75] Inventors: Minoru Usui; Toshiaki Oshima, both of Shiojiri, Japan

[73] Assignee: Epson Corporation, Nagano, Japan

[21] Appl. No.: 533,032

[22] Filed: Sep. 16, 1983

[30] Foreign Application Priority Data

Sep. 17, 1982 [JP] Japan ..... 57-162760
Sep. 17, 1982 [JP] Japan ..... 57-162761

[51] Int. Cl.[4] ..... B41J 15/04

[52] U.S. Cl. ..... 400/611; 400/65; 400/120; 400/307.2; 400/320; 400/328; 400/568; 400/569; 400/570

[58] Field of Search ..... 400/65, 120, 320, 328, 400/305, 570, 568, 569, 611, 613, 641; 101/93.15; 346/139 R, 155; 358/293

[56] References Cited

U.S. PATENT DOCUMENTS 3,518,699 6/1970 Mitchell ..... 346/155
4,062,436 12/1977 Kondur, Jr. et al. ..... 400/613 X
4,250,808 2/1981 Katsura et al. ..... 101/93.15
4,379,646 4/1983 Maeda ..... 400/641 X

FOREIGN PATENT DOCUMENTS 0476528 2/1972 Japan ..... 400/320

*Primary Examiner*—Ernest T. Wright, Jr.
*Attorney, Agent, or Firm*—Blum Kaplan Friedman Silberman & Beran

[57] ABSTRACT

The printer includes a print head moveable in a lateral direction perpendicular to the feeding direction of a sheet of recording paper. The print head is supported on a carriage which is reciprocably driven. Different paper feed pitches are selectable depending upon the lateral position of the carriage at the end of printing. A paper feed cam includes two or more feed grooves and pitch changing grooves connecting the feed grooves so that the paper feed means can operate from any selected one of the feed grooves. A cam follower connected to the carriage rides in a groove causing the paper feed cam to be driven by motion of the carriage. Different feed pitches for graphics and text are provided.

11 Claims, 14 Drawing Figures

PITCH-CHANGEABLE, CAM-ACTUATED PAPER FEED FOR SERIAL PRINTER

BACKGROUND OF THE INVENTION

This invention relates generally to a serial printer having a print head moveable across a print medium and more particularly to a serial dot-matrix printer. It is necessary in conventional dot-matrix printers to feed the sheet of print paper upon completion of one print cycle. Japanese Patent Publication No. 47-6528 discloses a head feed mechanism in the form of a helical cam having a reciprocating stroke. U.S. Pat. No. 4,250,808 shows a printer of the cycle-machine type. These prior art printers are designed in an attempt to achieve a small-size, and inexpensive printer construction. Some serial dot-matrix printers include, in addition to a head feed drive, a step motor or a plunger as a paper feed drive source for feeding the print paper at variable pitches to provide a graphics printing capability. A cycle-machine printer operates at all times in a mode equivalent to printing in a maximum allowable number of print positions, with the result that practical printing speed cannot be increased and the print paper cannot be fed at a fast speed or at different rates. A step motor or plunger for use as a paper feed driver has failed to provide a satisfactory small-size, inexpensive printer. Serial thermal printers incorporate a drive source such as for example a plunger for releasing the print head from the sheet of print paper when the latter is to be fed along. Such a printer however is complex in construction.

What is needed is a serial printer having a simple mechanism, small-size and low cost which is able to feed the print paper at variable pitches and at a fast rate. Also high speed printing capability is desirable.

SUMMARY OF THE INVENTION

Generally speaking, in accordance with the invention, a serial printer of the dot-matrix type is provided. The printer includes a print head moveable in a lateral direction perpendicular to the feeding direction of a sheet of recording paper. The print head is supported on a carriage which is reciprocably driven. Different paper feed pitches are selectable depending upon the lateral position of the carriage. A paper feed cam includes two or more feed grooves and pitch changing grooves connecting the feed grooves so that the paper feed means can operate from any selected one of the feed grooves. A cam follower connected to the carriage rides in a groove causing the paper feed cam to be driven by motion of the carriage. Diffent feed pitches for graphics and text are provided.

Accordingly, it is an object of this invention to provide an improved serial printer of the matrix type capable of feeding the print paper at variable pitches so as to provide both a graphics and a text printing capability.

Another object of this invention is to provide an improved serial printer of the matrix type having an increased printing speed.

A further object of this invention is to provide an improved serial printer of the matrix type which feeds print paper at a rapid rate.

Still another object of this invention is to provide an improved serial printer of the matrix type having a simple mechanism, small-size and low cost.

Still other objects and advantages of this invention will in part be obvious and will in part be apparent from the specification.

The invention accordingly comprises the features of construction, combination of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2(*b*) is a side elevational view, partly in section, of the carriage of FIGS. 1 and 2(*a*);

FIGS. 3(*b*) and (*c*) are enlarged plan views of a head release lever for the serial printer of FIG. 1;

DESCRIPTION OF THE PREFERRED EMBODIMENTS

An embodiment of a serial printer in accordance with the invention is now described.

Figure 1:
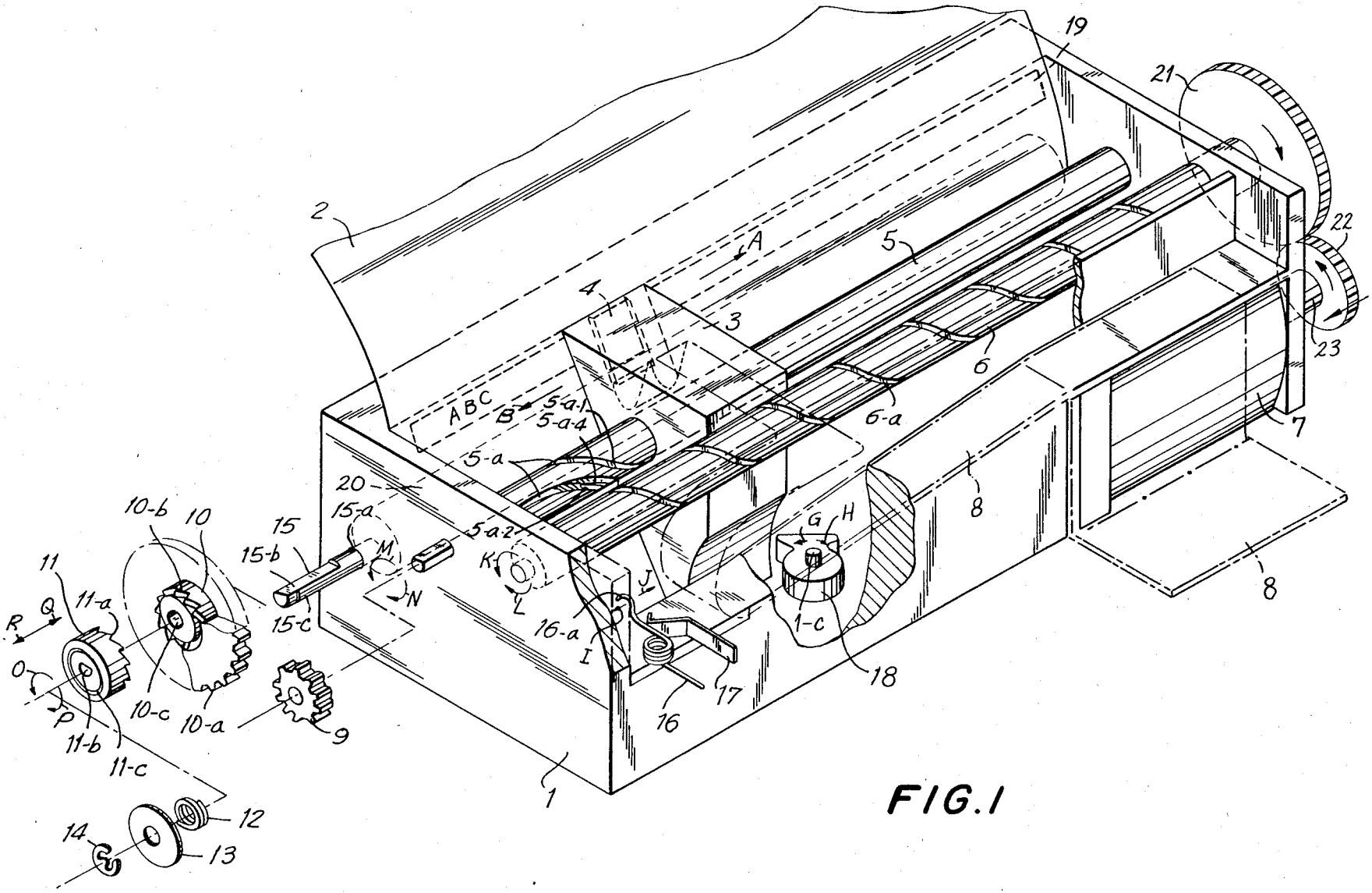
FIG. 1 is a top perspective view, partially exploded, of a serial printer in accordance with the invention.

With reference to FIG. 1, the printer includes a frame 1, a sheet 2 of recording paper facing a platen 19, carriage 3, thermal head 4, and paper feed cam 5 having a lead groove 5-*a*.

Figure 2A:
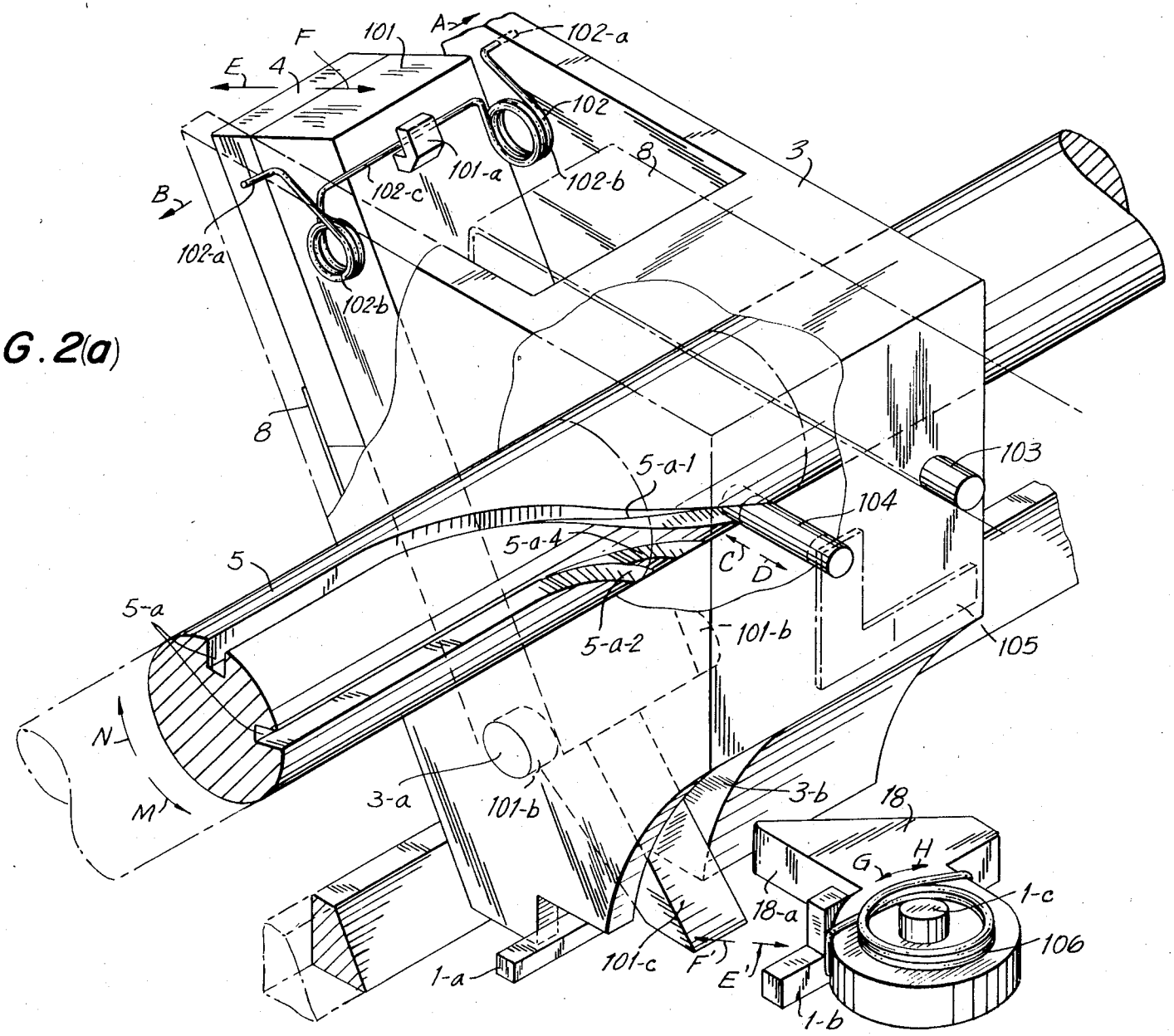
FIG. 2(*a*) is a perspective view to an enlarged scale of the carriage and cooperating parts of the printer of FIG. 1.
Figure 2B:
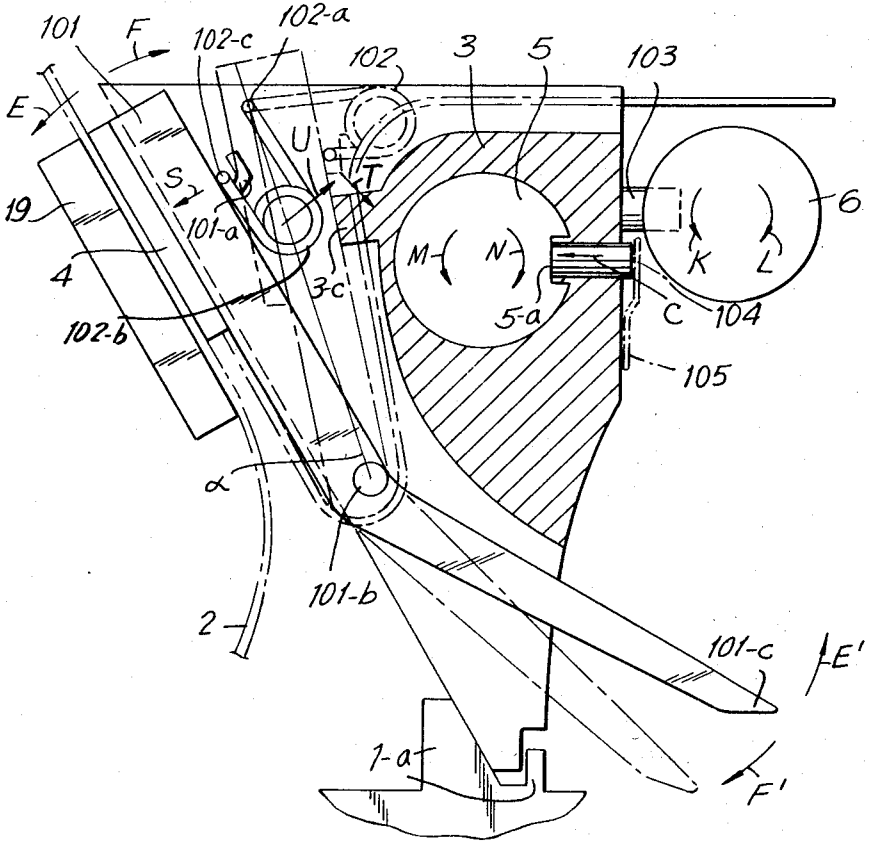

As illustrated in FIGS. 2(*a*) and 4, the cam groove 5-*a* includes a paper feed groove 5-*a*-1 for feeding the paper in a text mode, a paper feed groove 5-*a*-2 for feeding the paper 2 in a graphics mode, a pitch change groove 5-i a-3 for changing the paper pitch from the text mode to the graphics mode, and a connecting groove 5-*a*-4 interconnecting the graphics mode feed groove 5-*a*-2 and the text mode feed groove 5-*a*-1. A head feed cam 6 (FIG. 1) has a lead groove 6-*a* for laterally moving a thermal head 4. The paper feed cam 5 and the head feed cam 6 are rotatably supported on the frame 1. A motor 7 is fixed to the frame 1. A flexible printed board 8 (hereinafter referred to as an "FPC") is joined electrically to the head 4. A paper feed drive gear 9 is fixed on shaft 5*b* coaxially to the paper feed cam 5, and a paper feed roller shaft 15 to which a paper feed roller 20 is secured, feeds the recording paper 2. The paper feed roller shaft 15 supports thereon a paper feed gear 10, paper feed ratchet 11, paper feed spring 12 for urging paper feed ratchet 11 is direction Q, and spring seat 13, all disposed outside of the frame 1 and retained on the paper feed shaft 15 by an E-type retaining ring 14 engaging in a groove 15-*c* formed in the shaft 15. The paper feed gear 10 has a gear tooth section 10-*a*, a ratchet tooth section 10-*b*, and a hole 10-*c* through which a cylindrical portion 15-*a* of the paper feed roller shaft 15 extends so that the paper feed gear 10 can freely rotate thereon. The paper feed ratchet 11 has a ratchet tooth section 11-i a engageable in mesh with the ratchet tooth section 10-*b*, a hole 11-*b* having a D-shaped cross section through which a cutout portion 15-*b* of the shaft 15 having a D-shaped cross section extends for causing the paper feed ratchet 11 to rotate with the shaft 15, and a slot 11-*c* in which the paper feed spring 12 is mounted. Paper feed spring 12 urges paper feed ratchet 11 in direction Q. Terminals 16, 17 are for detecting a reset pulse, the terminal 16 being moveable in response to detection of a position of the carriage 3.

FIGS. 2(*a*) and 2(*b*) illustrate a heat radiation plate 101 to which the thermal head 4 is affixed. The heat radiation plate 101 has a lower cylindrical pin 101-*b* angularly moveably supported in circular holes 3-*a* defined in side walls of the carriage 3. The heat radiation plate 101 has an upper projection 101-*a* on which a central portion 102-*c* of a head spring 102 is pivotally supported. The head radiation plate 101 also has a lower projection 101-*c* extending rearwards of the carriage 3 through a recess 3-*b* defined in a lower back portion of the carriage 3. The head spring 102 serves to press the thermal head 4 against the recording paper 2, and has opposite ends 102-*a* pivotally attached to the carriage 3 with the central portion 102-*c* being pressed against the heat radiation plate 101. The head spring 102 also includes a pair of spring coils 102-*b*.

A carriage pin 103 is affixed to the carriage 3 and fitted in the groove 6-*a* in the head feed cam 6. The carriage pin 103 is drivable by the head feed cam 6 for laterally moving the carriage 3. The head feed cam 6 is driven by rotative power transmitted from the motor 7 through a train of gears 21 and 22 (FIG. 1). A paper feed pin 104 is attached to the carriage 3 and is normally biased by a paper feed pin spring 105 secured to the carriage 3 to move in the direction of the arrow C against the bottom of the groove 5-*a* in the paper feed cam 5.

The paper feed cam 5 serves as a shaft for guiding the carriage 3. The carriage 3 can therefore be positioned by the paper feed cam and walls 1-*a* on the frame 1. The head 4 is released from the platen 19 by a head release lever 18 at the time of feeding the recording paper 2. The head release lever 18 is normally urged by a coil spring 106 to rotate on pivot shaft 1-*c* in the direction of the arrow G into abutment against a projection 1-*b* on the frame 1. In the illustrated embodiment, the printer is capable of printing characters in forty print positions across the recording paper 2, and the head release lever 18 is positioned in the vicinity of the tenth print position on the frame 1.

Figure 3A:
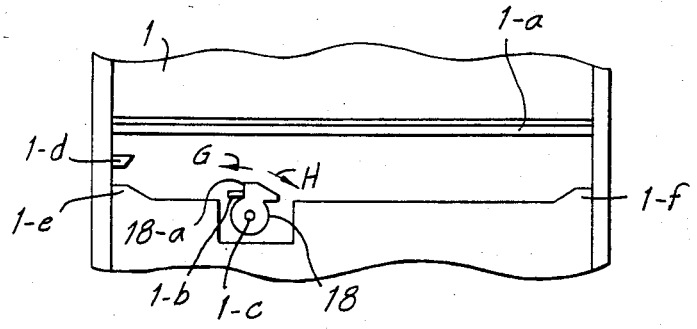
FIG. 3(*a*) is a fragmentary plan view of the frame of the printer of FIG. 1.
Figure 3B:
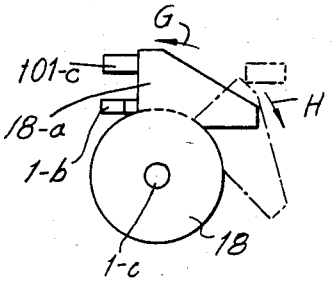
Figure 3C:
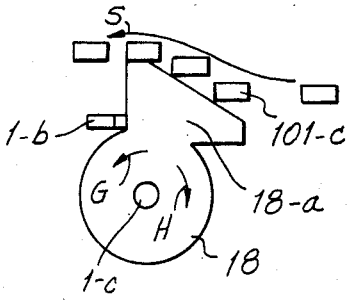

As illustrated in FIG. 3(*a*), there are projections 1-*d*, 1-*e*, 1-*f* disposed in the frame 1 and adjacent to the opposite side walls thereof. In FIG. 2(*b*), the carriage 3 has a projection 3-*c* against which the heat radiation plate 101 can be brought when the head 4 is released in the direction of the arrow F.

Figure 4:
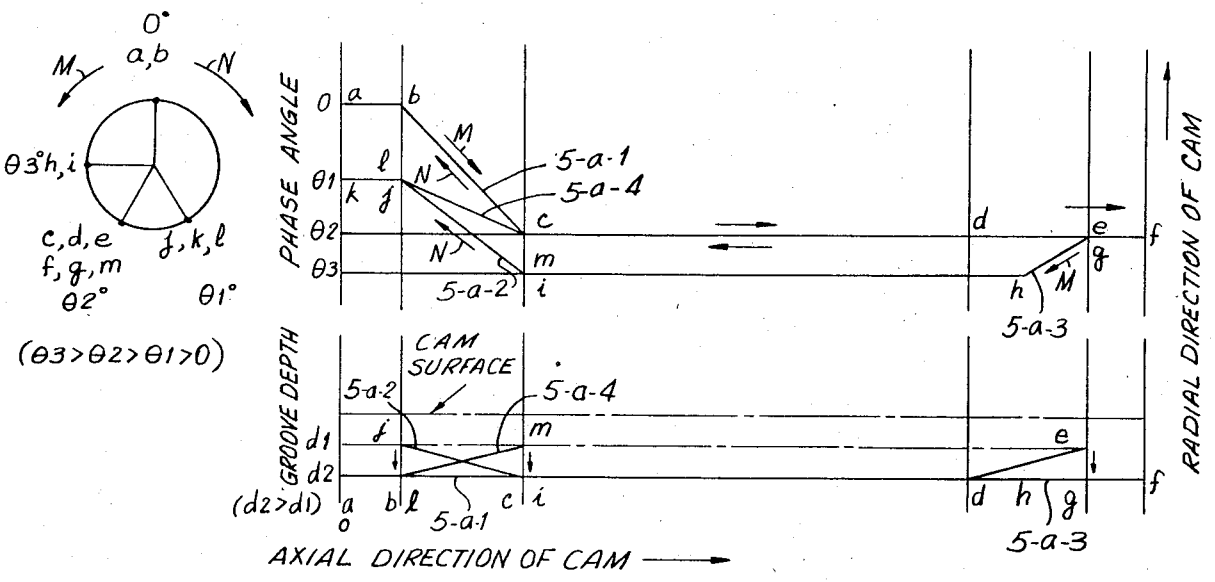
FIG. 4 is a diagram of the motions of a paper feed cam in the printer of FIG. 1.

FIG. 4 shows the formation pattern of the lead groove 5-*a* in the paper feed cam 5. The reference characters a through m, designate the central points of the lead groove, $d_1$ and $d_2$ designate the depths of the lead 5-*a* of the paper feed cam 5, and $\theta 1$, $\theta 2$, $\theta 3$ the phase angles of the points with the point a as a reference on the paper feed cam 5. Changes in depth of lead groove 5-*a* result in an in-and-out motion of paper feed pin 104 as shown by arrows C and D, in FIG. 2(*a*). As described above, the groove 5-*a* includes the paper feed groove 5-*a*-1 for a text mode, the paper feed groove 5-*a*-2 for a graphics mode, the paper feed pitch change groove 5-*a*-3, and the connecting groove 5-*a*-4.

Figure 5A:
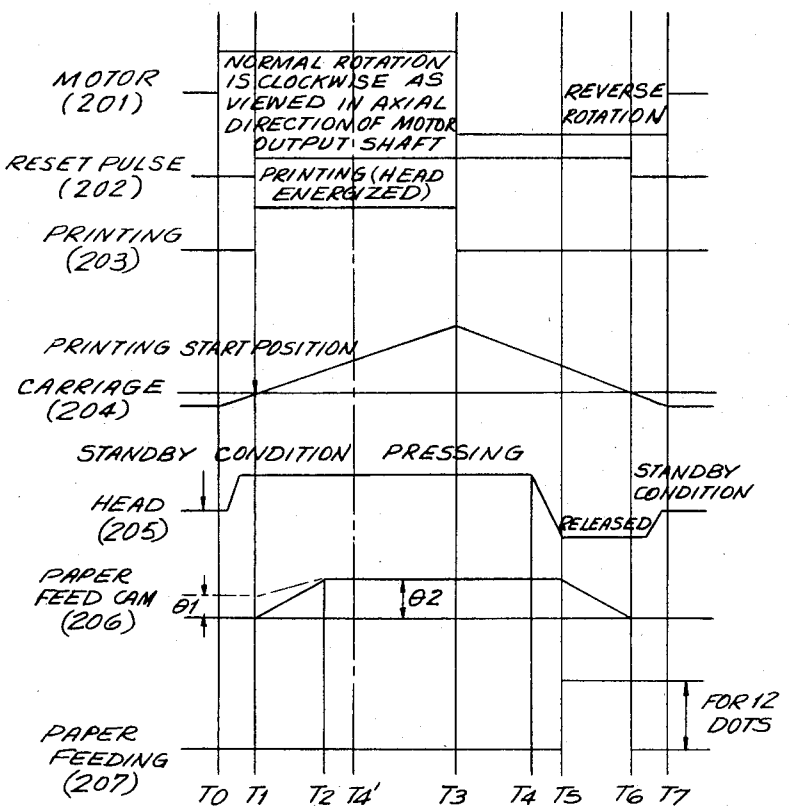
FIGS. 5(*a*), (*b*) are timing charts for text mode printing and graphics mode printing respectively, effected by the printer of FIG. 1.
Figure 5B:
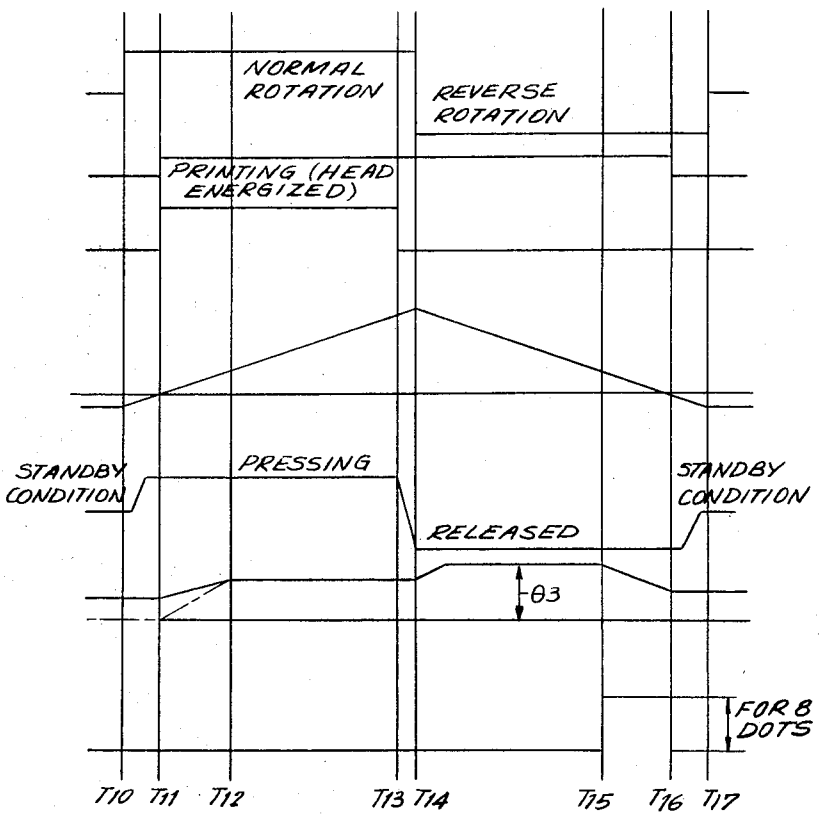

The curve numbered 201 at the left of FIG. 5(*a*) indicates the direction of rotation of the motor 7, curve 202 indicates the status of a reset signal, curve 203 printing by energization of the head 4, curve 204 indicates the movement of the carriage 3 across the print positions, curve 205 indicates the condition of the head 4 as pressed against the recording paper 2, curve 206 indicates the angular movement (phase angle) of the paper feed cam 5, and curve 207 indicates the paper feed operation. FIG. 5(*a*) illustrates operations in a text mode; operations in a graphics mode are illustrated at FIG. 5(*b*). The paper feed cam 6 operates as indicated by the two-dot-and-dash lines when the printer is shifted from the graphics mode to the text mode or from the text mode to the graphics mode.

Figure 6A:
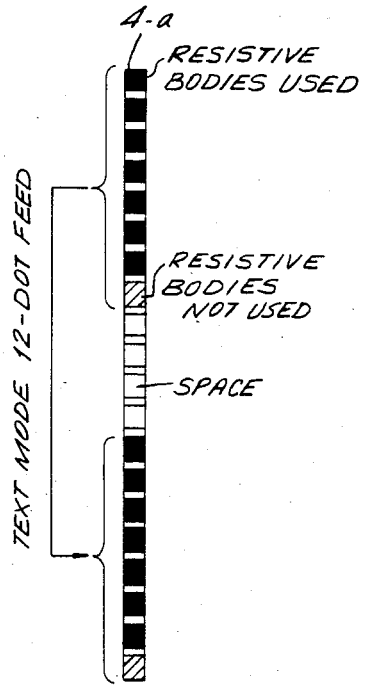
FIGS. 6(*a*), (*b*) are diagrams showing resistive heater elements and paper feed pitches used in the printing modes illustrated in FIGS. 5(*a*), (*b*)
Figure 6B:
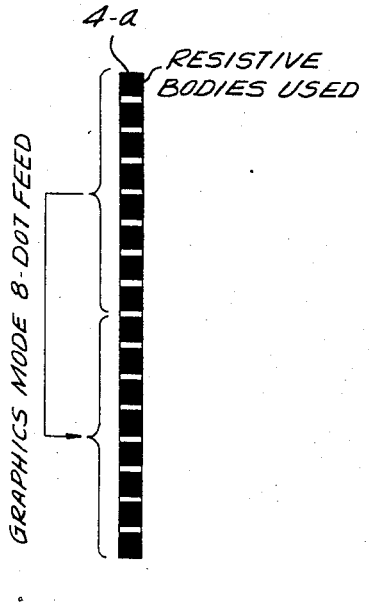

FIGS. 6(*a*) and 6(*b*) show positions 4-*a* of resistive heater elements attached to the thermal head 4 on the recording paper 2 for operating in a text mode and in a graphic mode, respectively. In this embodiment, the thermal head 4 has eight resistive elements.

(1) Operation in the text mode is now described.

(1-1) Standby position ($T_0$, $T_7$)

The printer is readied for printing in the position $T_0$ or $T_7$ as shown in FIG. 5(*a*). The carriage 3 is stopped in a position in which it presses a distal end 16-*a* of the movable terminal 16 of the reset detector in the direction of the arrow I (FIG. 1) to disconnect the movable terminal 16 from the fixed terminal 17. At this time, the paper feed pin 104 is fitted in the cam lead 5-*a* with the center of the pin 104 aligned with the point a as shown in FIG. 4. Also at this time, the projection 101-*c* of the heat radiation plate 101 is sandwiched not shown between the projections 1-*d*, 1-*e* which are carried on the frame 1 and are illustrated in FIG. 3(*a*). The heat radiation plate 101 is now urged by the head spring 102 to turn in the direction of the arrow E about the cylindrical pin 101-*b*. Therefore, the projection 101-i c tends to turn in the direction of the arrow E', but is prevented by the projection 1-*e* on the frame 1 from such angular movement. The thermal head 34 is thus kept from pressing the recording paper 2.

(1-2) Preparation for printing ($T_0$-$T_1$)

When the motor 7 is energized to start rotating its output shaft 23 clockwise as viewed in the direction to face the output shaft 23, the head feed cam 6 starts to rotate in the direction of the arrow K (FIG. 1). The carriage 3 then starts moving in the direction of the arrow A. The lower projection 101-*c* of the heat radiation plate 101 moves along a slanted surface of the projection 1-*e* on the frame 1. As the projection 101-*c* reaches the end of the slanted surface of the projection 1-*e*, the head 4 is pressed fully against the recording paper 2. In this position, the printer is ready for printing.

(1-3) Printing ($T_1$-$T_2$-$T_3$)

The carriage 3 moves in the direction of the arrow A to bring the moveable terminal 16 into electrical contact with the fixed terminal 17 in the position $T_1$, whereupon printing is started. At this time, the paper feed pin 104 is positioned at position b on the paper feed cam 5 as shown in FIG. 4. While the carriage 3 is being displaced to the position $T_2$, the paper feed pin 104 moves along the text mode feed groove 5-*a*-1 of the paper feed cam 5, that is, from the point b to the point c as shown in FIG. 4. The paper feed cam 5 is turned through $\theta 2$ in the direction of the arrow M. The paper feed drive gear 9 also angularly moves in unison with the paper feed cam 5 through $\theta 2$. The paper feed gear 10 in mesh with the paper feed drive gear 9 is turned in the direction of the arrow P through an interval corresponding to the ratio of speeds of rotation of the gears 9, 10. The paper feed gear 10 is in mesh with the ratchet 11 through the ratchet tooth sections **10-*b*, 11-*a*, and the ratchet 11 is rotatable in unison with the paper feed roller shaft 15. Since the ratchet tooth sections 11-*a*, 10-*b* can be smoothly brought out of mesh at this time, the ratchet 11 does not rotate about its own axis, but is moved axially in the direction of the arrow R along a slanted surface of the tooth section 10-*b* against the force of the paper feed spring 12. Therefore, the rotative power from the paper feed cam 5 is not transmitted to the paper feed roller shaft 15. Immediately after position $T_2$, the lower projection 101-*c* of the heat radiation plate 101 abuts against the projection 18-*a* of the head release lever 18. The head release lever 18 is then turned by the projection 101-*c* in the direction of the arrow H against the force of the spring 106. The projection 18-*a* is pushed by the projection 101-*c* to turn to the position shown by the two-dot-and-dash line in FIG. 3(*b*). When the projection 101-*c* moves past the two-dot-and-dash-line position in FIG. 3(*b*), the head release lever 18 is turned back in the direction of the arrow G under the resilient force of the spring 106 until it is engaged by the abutment 1-*b***. The parts are thus positioned at position $T_4'$. Desired printing is finished at position $T_3$.

(1-4) Return and paper feed ($T_3$-$T_4$-$T_5$-$T_6$-$T_7$)

The motor 7 starts to rotate in the opposite direction at position $T_3$. At this time, the paper feed pin 104 is located between the points c and e on the paper feed cam 5 in FIG. 4. The head feed cam 6 begins to rotate in the direction of the arrow L for enabling the carriage 3 to start returning in the direction of the arrow B. During this time, the lower projection **101-*c* of the heat radiation plate 101 moves along a path indicated by the arrow S in FIG. 3(*c*). When the projection 101-*c* reaches the position in which it engages the head release lever 18, the projection 101-*c* then moves along the slanted surface of the projection 18-*a* as the head release lever 18 is prevented by the abutment 1-*b* from turning in the direction of the arrow G. At this time, the projection 101-*c* turns about the cylindrical pin 101-*b* in the direction of the arrow F' as shown in FIG. 2(*b*), thereby causing the head 4** to rotate in the direction of the arrow F.

The central portion **102-*c* of the head spring 102 now turns about the attachment portion 102-*a* in the direction of the arrow U as shown in FIG. 2(*b*). When the central portion 102-*c* moves past an imaginary line $\alpha$ connecting between the center of the attachment portion 102-*a* and the center of the cylindrical pin 101-*b*, the spring force of the head spring 102 changes its direction from the direction of the arrow S to the direction of the arrow T. Then, the head spring 102 is instantaneously displaced to the two-dot-and-dash-line position. Simultaneously, the heat radiation plate 101 and the head 4 are also angularly moved to the two-dot-and-dash-line position. The heat radiation plate 101 is stopped when engaged by the abutment projection 3-*c* on the carriage 3. Since the spring force of the head spring 102 acts in the direction of the arrow T at this time, the head 4 is stably retained in the two-dot-and-dash-line position as illustrated in FIG. 2(*b*). In this position, the head 4 is not pressed against the recording paper 2**. Such movement is carried out in an interval from the time $T_4$ to the time $T_5$.

At the time $T_5$, the center of the paper feed pin 104 on the carriage 3 is located in the point c as shown in FIG. 4. During the $T_4$-$T_5$ interval, the paper feed pin 104 is displaced along the text mode feed groove **5-*a*-1 from the point c to the point b as shown in FIG. 4. This causes the paper feed cam 5 to turn through $\theta 2$ in the direction of the arrow N. The paper feed drive gear 9 is also turned through $\theta 2$ in the direction of the arrow N. The paper feed gear 10 in mesh with the paper feed drive gear 9 is rotated in the direction of the arrow 0 for an angular interval corresponding to the speed reduction ratio between the gears 9, 10**.

Since the ratchet tooth section **11-*a* of the paper feed ratchet 11, urged in direction Q, lockingly engages the ratchet tooth section 10-*b* of the paper feed gear 10 at this time, the paper feed ratchet 11 rotates in unison with the paper feed gear 10. The paper feed roller shaft 15, rotatable with the paper feed ratchet 11, is also rotated in the direction of the arrow 0 for an angular interval equal to that of the angular movement of the paper feed gear 10. The recording paper 2 is now fed along for the pitch distance necessary for printing in the text mode in response to rotation of the paper feed roller 20 rotating with the paper feed roller shaft 15. For example, the recording paper 2 is fed along for a pitch distance equal to twelve dots marked by the head resistive elements 4-*a* as shown in FIG. 6(*a*)**. In such an example, a space between adjacent printed characters corresponds to five dots where one character is composed of $5 \times 7$ dots. The above operation is completed at a time $T_6$.

At this time, the moveable terminal 16 is brought into electrical contact with the fixed terminal 17. The carriage 3 continuously moves in the direction of the arrow B, during which time the lower projection **101-*c* of the heat radiation plate 101 moves along the slanted surface of the projection 1-*d* on the frame 1. The projection 101-*c* turns in the direction of the arrow E' and stops on abutment against the projection 1-*e***. The parts are now returned at time $T_7$ to the condition assumed at the time $T_0$ prior to the printing.

(1-5) Test mode printing started from standby position after graphics mode printing, is described. This operation is indicated by the two-dot-and-dash lines in the timing chart of FIG. **5(*a*)**.

The standby condition after graphics mode printing differs from that after text mode printing in that the paper feed pin 104 is differently positioned on the paper feed cam 5. The paper feed pin 104 is located in the point k on the paper feed cam 5 as shown in FIG. 4. The point k is angularly displaced from the point a through $\theta_1$ in the direction of the arrow L.

When the motor 7 is energized to rotate the output shaft 23 in a clockwise direction (referred to as "normal rotation") as viewed toward the output shaft 23, the carriage 3 is moved in the direction of the arrow A in the same manner as described under (1-1). The paper feed pin 104 advances along the connecting groove **5-*a*-4 on the paper feed cam 5 from the point k to the point l as shown in FIG. 4. The paper feed pin 104 is at the point l at time $T_1$. The paper feed cam 5 has different depths at the points l and j, that is, the point l is deeper than the point j. The point l is located at the bottom of the lead 5-*a* of the paper feed cam 5, while the point j is located in the space of the cam groove 5-*a*-4**.

The paper feed pin 104 is normally pushed in the direction of the arrow C under the force of the paper feed pin spring 105 into abutment against the bottom of the paper feed cam lead 5-*a*. Therefore, when the carriage 3 moves from the condition at time $T_1$ in the direction of the arrow A, the paper feed pin 104 does not follow the path from the point j to the point l in the lead 5-*a*, but moves along the connecting groove 5-*a*-4, that is, from the point l to the point m. At this time, the paper feed cam 5 rotates in the direction of the arrow K through an angular interval ($\theta_2$-$\theta_1$). As described above under (1-3), the paper feed roller 20 does not rotate and no paper 2 is fed along. Subsequent to time $T_2$, the printer operates in the same manner as described in detail under (1-3) and (1-4).

(2) The graphics mode of operation is now described.

(2-1) Standby condition, preparation for printing, and printing ($T_{10}$-$T_{11}$-$T_{12}$-$T_{13}$)

In this process, the printer operates in exactly the same manner as in the text mode printing, as shown in the timing chart of FIG. 5(*b*). The two-dot-and-dash line indicates movement of the paper feed cam 5 from the standby position after the text mode printing.

(2-2) Head release ($T_{13}$-$T_{14}$)

The motor 7 is continuously rotated clockwise (normal rotation) after printing has been completed. The carriage 3 is moved to the position in which the lower projection 101-*c* of the heat radiation plate 101 hits the projection 1-*f* on the frame 1. Continued normal rotation of the motor 7 moves the carriage 3 in the direction of the arrow A, while the projection 101-*c* travels along the slanted surface of the projection 1-*f*. At this time, the projection 101-*c* rotates in the direction of the arrow F′ to cause the head 4 to turn in the direction of the arrow F until the head 4 is stably stopped in a position to release the recording paper 2 at a time $T_{14}$.

During the process, the head 4 moves in the same manner as described under (1-4). In an interval from $T_{13}$ to $T_{14}$, the paper feed pin 104 moves on the paper feed cam 5 past the point e as shown in FIG. 4, the point e being different from the point g only as to the depth on the cam 5. Since the paper feed pin 104 is held against the bottom of the lead 5-*a* of the paper feed cam 5 under the force of the paper feed pin spring 105, the paper feed pin 104 becomes pressed against the point g under the bias of the spring 105 when the paper feed pin 104 arrives at the point e. Thereafter, the paper feed pin 104 moves from the point g to the point f. The paper feed pin 104 reaches the point f at the time $T_{14}$.

In the graphics mode, it is necessary to move the carriage 3 in the direction of the arrow A for a larger interval than any intervals that the carriage 3 would move in a text mode. In the illustrated embodiment, the printer is capable of printing forty print positions on the recording paper 2. In the text mode, the carriage 3 moves across a maximum of 240 printed dots, while in the graphics mode, the carriage 3 moves across 256 printed dots at all times. Therefore, 256 dots can be printed in the graphics mode.

(2-3) Return and paper feed ($T_{14}$-$T_{15}$-$T_{16}$-$T_{17}$)

The motor 7 is reversed at the time $T_{14}$. The head feed cam 6 starts rotating in the direction of the arrow L to shift the carriage 3 in the direction of the arrow B. The paper feed pin 104 now moves from the point f to the point g as shown in FIG. 4. Since the cam is deeper at the point g than at the point e, the paper feed pin 104 does not move from the point e to the point d, but from the point g to the point h. During this process, the paper feed pin 104 enters the pitch change groove 5-*a*-3 to rotate the paper feed cam 5 in the direction of the arrow M through an angular interval ($\theta_3$-$\theta_2$).

The paper feed gear 10 then rotates in the direction of the arrow P. Since the ratchet tooth section 10-*b* of the paper feed gear 10 and the ratchet tooth section 11-*b* of the paper feed ratchet 11 are smoothly movable out of mesh with each other, the paper feed roller 20 does not rotate and hence the recording paper 2 is not fed along. Thereafter, the paper feed pin 104 moves from the point h to the point i on the paper feed cam 5 as the carriage 3 moves in the direction of the arrow B. While the paper feed pin 104 moves from the point i to the point j in the graphics mode feed cam groove 5-*a*-2, the paper feed cam 5 is turned in the direction of the arrow N for an interval ($\theta_3$-$\theta_1$). This corresponds to an interval from $T_{15}$ to $T_{16}$.

Responsive to this, the paper feed gear 10 rotates in the direction of the arrow O for an interval corresponding to the speed reduction ratio between the gears 9, 10. At this time, the ratchet tooth sections 10-*b* and 11-*b* lockingly engage with each other as described in detail under (1-4), the paper feed ratchet 11 rotates in unison with the paper feed gear 10 in the direction of the arrow O. Consequently, the paper feed roller 20 also rotates in the direction of the arrow O for the interval ($\theta_3$-$\theta_1$) to feed the recording paper 2. Through selecting the amount of feed of the recording paper 2 so as to be equal to eight dots printed by the heater elements 4-*a* on the head 4, a graphics pattern can be printed by heating desired ones of the eight heater elements 4-*a* as shown in FIG. 6(*b*).

At the time $T_{16}$, the paper feed pin 104 moves from the point j to the point l on the paper feed cam 5 under the action of the paper feed pin spring 105. Thereafter, the paper feed pin 104 moves from the point l to the point k in response to movement of the carriage 3 in the direction of the arrow B, whereupon the printer is in standby condition at the time $T_{17}$. This process is the same as that described under (1-4).

For continuous printing in the graphics mode, the operations under (1-5), (2-2) and (2-3) are repeated from the condition at the time $T_{17}$, that is, the condition in which operation of the paper feed cam 5 is shown by the two-dot-dash line at the time $T_{10}$.

(3) Fast paper feed is now described.

The printer is operated in the manner as described under (1-1), (1-2) and (1-3) until the condition at time $T_4'$ is reached. At this time, the head 4 is not energized. The motor 7 is reversed in its rotation at the time $T_4'$. The recording paper 2 can then be fed along for the same interval as that in the text mode as described under (1-4). The recording paper 2 is fed along while the $T_4'$-$T_4$ interval is omitted. This sequence of operations is repeated to effect fast paper feed. Since the printer is capable of printing forty print positions with the head release lever positioned in the vicinity of the tenth print position, the paper can be fed along at a fast rate by reciprocably moving the carriage 3 up to the tenth print position.

Figure 7:
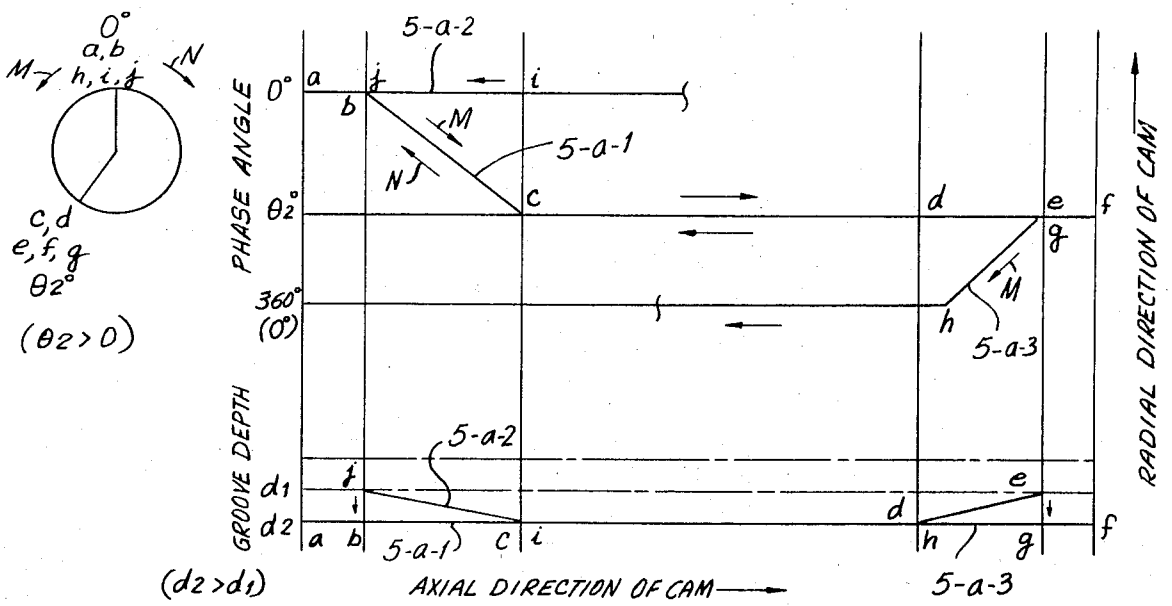
FIGS. 7–9 are diagrams simlar to FIG. 4 for paper feed cams in alternative embodiments of serial printers in accordance with the invention.

According to a second embodiment of a serial printer in accordance with the invention, phase angles $\theta 1$, $\theta 2$ as shown in FIG. 4 are selected to be 360 degrees (=0°). The pattern of the cam 5 is illustrated in FIG. 7. In this embodiment, the paper feed groove 5-*a*-2 has no phase angle difference between the points i and j as shown in FIG. 7. The paper feed groove 5-*a*-2 illustrated is of a most extreme pattern. When the carriage 3 is moved successively along groove 5-a-2 from the point d to the points e, f, g, h, i, and j to a, the recording paper 2 is not fed along. By employing the paper feed cam 5 as illustrated in FIG. 7, two modes can be provided; in one mode, the recording paper 2 can be fed along at a constant feed pitch (feed pitch in the graphics mode, for example), and in the other mode, the recording paper 2 is not fed along.

Since the paper feed groove 5-a-2 is connected to the paper feed groove 5-a-1 at the point b in this embodiment, a connecting groove 5-a-4 is unnecessary.

The details of this embodiment are substantially the same as those in the previous embodiment, except that the graphics mode in the former embodiment is changed into a no-paper-feed mode. With this embodiment, it is rendered possible to scan one location twice or more times (a process known as "multipass") for printing, so that characters can be printed in an exaggerated fashion. When data are transferred at a rate lower than the printing speed of a printer while one line is being printed, the same line can be printed again, with the result that a failure in printing any line can be prevented even without a one-line buffer memory.

Figure 8:
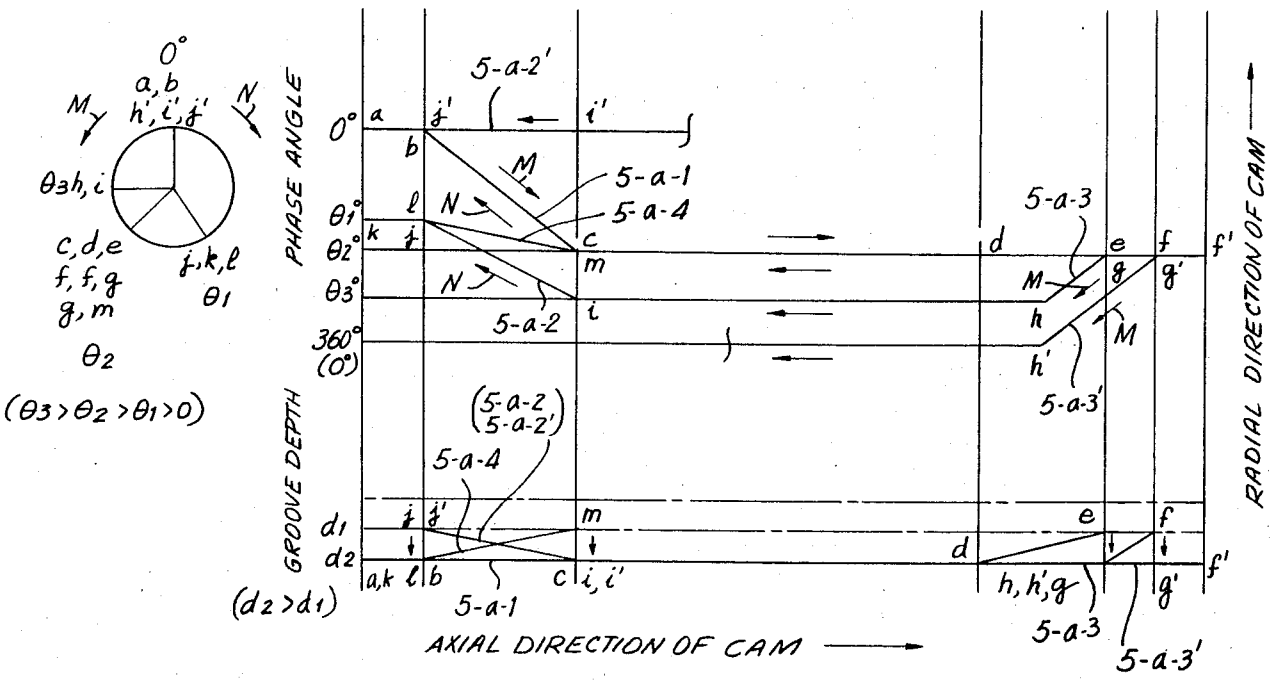

A third embodiment of a serial printer in accordance with the invention is a combination of the first and second embodiments. For example, a paper feed cam 5 may be of a pattern as shown in FIG. 8.

The third embodiment is of the same arrangement as that of the first embodiment as far as the cam points a through m are concerned. However, a cam pattern f'-j' is added as a no-paper-feed mode as in the second embodiment. When the carriage 3 returns after it has completed the movement in the points c and e, the recording paper 2 is fed along the text mode. When the carriage 3 returns after it has completed the movement in the points 3–f, the recording paper 2 is fed along in the graphics mode, e.g. along paper feed graphics groove 5-a-2. When the carrige 3 returns after it has completed the movement in the points f–f', recording paper 2 is not fed along, e.g. motion is along paper feed pitch change groove 5-a-3, as shown at the 0° level of FIG. 8. With the third embodiment, therefore the recording paper 2 can be selectively fed along in three modes as shown by the left-pointing arrows of FIG. 8 simply by controlling the amount of movement of the carriage 3.

Figure 9:
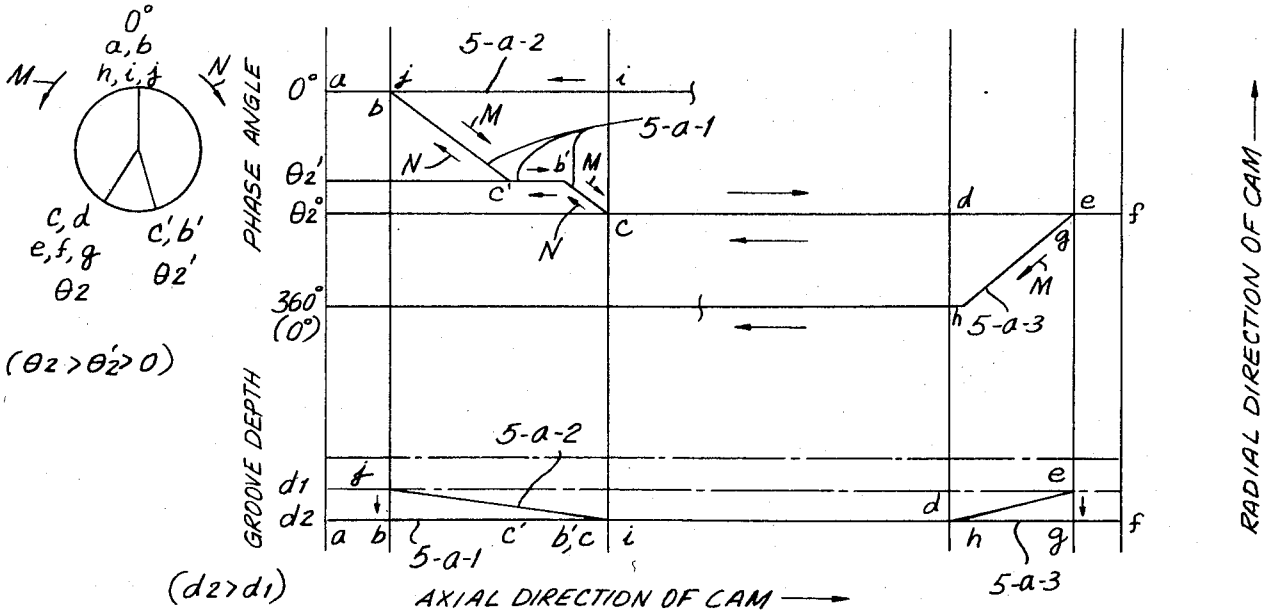

According to a fourth embodiment of a serial printer in accordance with the invention, the paper feed cam groove 5-a-1 in the second embodiment is composed of two groove sections. FIG. 9 is illustrative of the pattern of a paper feed cam 5 according to the fourth embodiment. The paper feed groove 5-a-1 includes two paper feed groove sections, one from point b to c' and the other from point b' to c. In the fourth embodiment, the phase angle $\theta_2$ is determined to effect paper feeding in a text mode for an interval equivalent to twelve dots, and the phase angle $\theta_2'$ is determined to effect paper feeding in a graphics mode for an interval equivalent to eight dots.

Switching between the text mode and the graphics mode according to the fourth embodiment will be described. In the text mode, the carriage 3 is moved to the point c to e, and then returned to the home position in the same manner as that according to the preceding three embodiments. In the graphics mode, the no-paper-feed mode is carried out in the same manner as that in the second embodiment. More specifically, the carriage 3 is moved to the point e to f, and returned to the home position. Thereafter, the carriage 3 is moved to the point c' to b', and then returned to the home position. At this time, the paper feed cam 5 is rotated in the direction of the arrow N through an interval corresponding to the phase angle $\theta_2'$. Such an interval of angular movement is determined to perform paper feeding in the graphics mode for the interval of eight dots. Therefore, the recording paper 2 can be fed along in the graphics mode.

In the fourth embodiment, however, the head release lever 18 and its associated mechanism as described in the first embodiment need to be positioned in the point c' to b' for moving the head 4 out of engagement with the recording paper 2 when the carriage 3 moves to the point c' to b'. With the fourth embodiment, too, the recording paper 2 can be fed along selectively in three modes simply by controlling the amount of movement of the carriage 3.

With the arrangement of the present invention, as described above, a printer can feed a sheet of recording paper 2 at variable paper feed pitches through a simple construction capable of varying the amount of rotation of a paper feed roller 20 dependent on the distance of reciprocal movement of the carriage 3, thus providing both graphics and text mode printing capabilities. The practical printing speed can be increased by rotating the printer motor 7 in normal and reverse directions. The recording paper 2 can be fed along at a fast rate simply by reciprocably moving the carriage 3 slightly in a direction across print positions.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A serial printer for printing on a sheet of recording paper, said printer having a print head moveable in a lateral direction perpendicular to the direction of feeding of said sheet of recording paper, said print head printing on a portion of said sheet confronting said print head, comprising:

carriage means supporting said print head thereon;

drive means for reciprocally moving said carriage means laterally, advancing in a first direction and returning in a second direction;

paper feed pitch selection means for selecting among a plurality of paper feed pitches, said selection of pitch being dependent on the lateral distance of movement of said carriage means in said first direction;

paper feed means for feeding said sheet of recording paper, said paper feed means being driven by said paper feed pitch selection means, said pitch selection means including a paper feed cam having at least two paper feed grooves therein, and at least one paper feed pitch changing groove for connecting between said at least two paper feed grooves;

paper feed cam drive means connected to and moving with said carriage means for engaging said grooves of said paper feed cam for driving said paper feed cam as said carriage means moves, said cam drive means and said selection means engaging a particularly selected feed groove in dependence upon the lateral position of said carriage means in said first direction when said reciprocal motion is changed from said first to said second direction, said paper being advanced in said direction of feeding by different distances for each said groove.

2. A serial printer as claimed in claim 1, wherein said print head is a thermal print head.

3. A serial printer as claimed in claim 1, wherein said print head is pivotally mounted on said carriage means and further comprising bistable displacement means for providing two stable conditions of pivoting for said print head, in a first stable condition said print head being pressed against said sheet of recording paper for recording thereon, and in the second stable condition, said print head being held away from said recording paper, said print head when away from said recording paper, allowing said carriage means to return to a starting position after printing and allowing advancement of said paper without marring said paper or interfering with the motion thereof.

4. A serial printer as claimed in claim 2, wherein said print head is pivotally mounted on said carriage means and further comprising bistable displacement means for providing two stable conditions of pivoting for said print head, in a first stable condition said print head being pressed against said sheet of recording paper for recording thereon, and in the second stable condition, said print head being held away from said recording paper, said print head when away from said recording paper, allowing said carriage means to return to a starting position after printing and allowing advancement of said paper without marring said paper or interfering with the motion thereof.

5. A serial printer as claimed in claim 3, and further comprising a frame for supporting at least said carriage means for said reciprocal motion, and further comprising switch means for setting said bistable displacement means selectively in said first or second stable condition, said switch means operating in response to the relative motion between said carriage means and said frame.

6. A serial printer as claimed in claim 4, and further comprising a frame for supporting at least said carriage means for said reciprocal motion, and further comprising switch means for setting said bistable displacement means selectively in said first or second stable condition, said switch means operating in response to the relative motion between said carriage means and said frame.

7. A serial printer as claimed in claim 1, wherein said print head operates in a matrix mode and further including a line of print elements moving in unison laterally across said recording paper.

8. A serial printer as claimed in claim 1, wherein said paper feed cam drive means is a cam follower sliding in said grooves of said paper feed cam, said grooves varying in depth locally, the depth of said groove when the reciprocal motion of said carriage means reverses direction determining which of said feed grooves said cam follower follows in the next traverse of said carriage means.

9. A serial printer as claimed in claim 1, wherein said print head begins a traverse in said first direction for printing with said carriage means starting from a standby position and returns in said second direction to said standby position after completion of said traverse for printing, said paper feed cam drive means and paper feed means advancing said paper at the completion of said traverse in said second direction.

10. A serial printer as claimed in claim 9, wherein said paper feeding means feeds said paper when returning to said standby position after said carriage means has made only a partial traverse in said first direction, a quick feeding operation being achieved.

11. A serial printer as claimed in claim 1, wherein said paper feed means includes a ratchet type clutch and a paper feed roller on a shaft, said clutch being mounted on the shaft of said paper feed roller and being driven by a shaft associated with said paper feed cam drive means, said clutch being engaged to rotate said paper feed roller shaft and advance said recording paper.

* * * * *